United States Patent [19]

Takasugi et al.

[11] Patent Number: 4,949,776

[45] Date of Patent: Aug. 21, 1990

[54] MOLTEN METAL POURING NOZZLE FOR CONTINUOUS CASTING MACHINE HAVING ENDLESS-TRAVELLING TYPE MOLD

[75] Inventors: Hideto Takasugi; Akichika Ozeki; Masami Komatsu; Masayuki Nakada; Hisahiko Fukase, all of Tokyo, Japan

[73] Assignees: NKK Corporation; Ishikawajima-Harima Jukogyo Kabushiki Kaisha, both of Tokyo, Japan

[21] Appl. No.: 362,023

[22] Filed: Jun. 6, 1989

[30] Foreign Application Priority Data

Jun. 21, 1988 [JP] Japan ..... 63-153014

[51] Int. Cl.[5] ..... B22D 11/06; B22D 11/10

[52] U.S. Cl. ..... 164/437; 222/591; 164/488

[58] Field of Search ..... 164/452, 453, 481, 488, 164/154, 430, 431, 432, 433, 434, 437, 438; 222/591

[56] References Cited

U.S. PATENT DOCUMENTS 4,602,668 7/1986 Bolliger ..... 164/154

FOREIGN PATENT DOCUMENTS 59-146975 8/1984 Japan ..... 164/437
59-156963 9/1984 Japan ..... 164/437
61-086052 5/1986 Japan ..... 164/437
61-195753 8/1986 Japan ..... 164/430

*Primary Examiner*—Richard K. Seidel
*Assistant Examiner*—Rex E. Pelto
*Attorney, Agent, or Firm*—Frishauf, Holtz, Goodman & Woodward

[57] ABSTRACT

A molten metal pouring nozzle for a continuous casting machine having an endless-travelling type mold, wherein the endless-travelling type mold is formed with two pairs of opposing wall members endlessly travelling in the same direction and at the same speed, and one end of the pouring nozzle is connected to a tundish for receiving molten metal, and the other end of the pouring nozzle is inserted into the mold. The molten metal pouring nozzle of the present invention comprises a nozzle body made of a refractory and a flow regulator made of a refractory. The nozzle body (14, 20) has a bore (1*a*, 3*a*), through which molten metal flows, along the axial line thereof, and the sectional area of the downstream end portion of the bore (1*a*, 3*a*) becomes gradually larger toward the downstream end thereof. The flow regulator (15, 18) is arranged at the center of the downstream end portion of the bore (1*a*, 3*a*) of the nozzle body (14, 20). The flow regulator (15, 18) forms, in cooperation with the bore (1*a*, 3*a*), a path for molten metal, by which molten metal flowing through the bore (1*a*, 3*a*) impinges against the inner surface of the mold, near the downstream end of the nozzle body (14, 20).

5 Claims, 3 Drawing Sheets

MOLTEN METAL POURING NOZZLE FOR CONTINUOUS CASTING MACHINE HAVING ENDLESS-TRAVELLING TYPE MOLD

FIELD OF THE INVENTION

The present invention relates to a pouring nozzle, in a continuous casting machine having an endless-travelling type mold, for pouring molten metal received in a tundish into the mold.

BACKGROUND OF THE INVENTION

As a facility for continuous casting of molten metal, there is known a continuous casting machine having an endless-travelling type mold which comprises a plurality of endlessly connected metal blocks or an endless-travelling type mold which comprises an endless metal belt.

FIG. 1 is a schematic side view illustrating a conventional continuous casting machine having an endless-travelling type mold. In FIG. 1, 4 is an endless-travelling type mold; and 2 is a wall member forming part of the endless-travelling type mold. The wall member 2 comprises a plurality of endlessly connected metal blocks 5 and a pair of sprockets 12. The plurality of endlessly connected blocks 5 are stretched between the pair of sprockets 12. The wall member 2 comprising the plurality of endlessly connected blocks 5 travels endlessly by the action of a driving device (not shown) provided on at least one of the pair of sprockets. A pair of wall members 2 having the construction as described above are arranged one above the other with a prescribed distance therebetween as shown in FIG. 1. More specifically, the pair of wall members 2 are vertically opposed to each other. Although not shown in FIG. 1, another pair of wall members having the same construction as the pair of vertically opposed wall members 2, are arranged with a prescribed distance therebetween on the both sides of the pair of vertically opposed wall members 2. More specifically, the another pair of wall members are horizontally opposed to each other. The pair of vertically opposed wall members 2 and the another pair of horizontally opposed wall members travel endlessly toward the downstream in the same direction and at the same speed. Thus, the above-mentioned two pairs of wall members form the endless-travelling type mold (hereinafter simply referred to as the "mold") 4. The mold 4 is usually installed at a prescribed downward inclination angle toward the downstream.

As shown in FIG. 1, upstream end of a conventional molten metal pouring nozzle 10 made of a refractory is connected to a lower portion 11*a* of a side wall of a tundish 11, and the downstream end of the molten metal pouring nozzle 10 is inserted into an inlet of the above-mentioned mold 4.

Molten metal received in the tundish 11 is continuously poured into the mold 4 through a bore of the pouring nozzle 10. The above-mentioned two pairs of wall members 2 forming the mold 4 are forcedly cooled by means of a cooling device (not shown). Molten metal 8 poured into the mold 4 is therefore solidified into a cast metal strand 9 in the mold 4. The cast metal strand 9 is continuously moved toward the downstream by the action of the endlessly travelling mold 4. The cast metal strand 9 is then squeezed and withdrawn from the mold 4 by means of at least one pair of pinch rolls 13 which rotate synchronously with the travelling speed of the endlessly travelling mold 4, whereby the cast metal strand 9 is continuously cast.

However, when continuously casting the cast metal strand 9 by the use of the conventional molten metal pouring nozzle 10, the following problems are encountered.

FIG. 2 is a partial sectional view illustrating a conventional molten metal pouring nozzle 10, the downstream end of which is inserted into the inlet of an endless-travelling type mold. In FIG. 2, the arrow indicates the flow direction of molten metal 8 in the mold. Molten metal 8 poured into the mold through the bore of the pouring nozzle 10 is cooled and solidified by the wall members 2 each comprising the plurality of endlessly connected metal blocks 5, and a solidified shell 6 is formed along the surface of the wall member 2 of the mold. At this time, a basic end portion 6*a* of the solidified shell 6 is firstly formed at a corner formed by the downstream end face 10*a* of the pouring nozzle 10 and the surface of the wall member 2. The basic end portion 6*a* of the solidified shell 6 tends to easily adhere to the downstream end face 10*a* of the pouring nozzle 10. Therefore, a tensile strain is produced in the solidified shell 6 of the cast metal strand 9, when the solidified shell 6 is pulled toward the downstream by the endlessly travelling wall members 2, thus resulting in occurrence of such defects as cracks and flaws on the surface of the cast metal strand 9. Sometimes, the basic end portion 6*a* of the solidified shell 6 is cut off from the body of the solidified shell 6, and the thus cut-off basic end portion 6*a* is entrapped into molten metal 8 in the mold, thus causing deterioration of the quality of the cast metal strand 9. Furthermore, the downstream end portion of the pouring nozzle 10, to which the basic end portion 6*a* of the solidified shell 6 has adhered, is pulled by the solidified shell 6 moving toward the downstream, and as a result, the downstream end portion of the pouring nozzle 10 may be broken. Pieces of the broken pouring nozzle 10 are entrapped into molten metal in the mold, thus causing deterioration of the quality of the cast metal strand 9. In addition, the pouring nozzle 10, if used as broken, may result in such a danger as leakage of molten metal 8 from the broken portion of the pouring nozzle 10, thus interrupting the casting operation.

Adhesion of the basic end portion 6*a* of the solidified shell 6 to the downstream end face 10*a* of the molten metal pouring nozzle 10, exerts adverse effects on the continuous casting operation as described above. There is therefore a strong demand for the development of a molten metal pouring nozzle for a continuous casting machine having an endless-travelling type mold, in which a basic end portion of a solidified shell of a cast metal strand never adheres to the downstream end face of the pouring nozzle, but such a pouring nozzle has not as yet been proposed.

SUMMARY OF THE INVENTION

An object of the present invention is therefore to provide a molten metal pouring nozzle for a continuous casting machine having an endless-travelling type mold, in which a basic end portion of a solidified shell of a cast metal strand never adheres to the downstream end face of the pouring nozzle.

In accordance with one of the features of the present invention, in a molten metal pouring nozzle for a continuous casting machine having an endless-travelling type mold, comprising:

said endless-travelling type mold is formed with two pairs of opposing wall members endlessly travelling in the same direction and at the same speed; said pouring nozzle is made of a refractory and has a bore, through which molten metal flows, along the axial line thereof, one end of said pouring nozzle is connected to a tundish for receiving molten metal, and the other end of said pouring nozzle is inserted into said mold;

According to the improvement of the present invention, said molten metal pouring nozzle (1, 3) comprises:

a nozzle body (14, 20) having said bore (1*a*, 3*a*) along the axial line thereof, the sectional area of the downstream end portion of said bore (1*a*, 3*a*) becoming gradually larger toward the downstream end thereof; and a flow regulator (15, 18) made of a refractory, arranged at the center of the downstream end portion of said bore (1*a*, 3*a*) of said nozzle body (14, 20), flow regulator (15, 18) forming, in cooperation with said bore (1*a*, 3*a*), a path for molten metal, by which molten metal flowing through said bore (1*a*, 3*a*) impinges against the inner surface of said mold, near the downstream end of said nozzle body (14, 20).

DETAILED DESCRIPTION OF PREFERRED EMBODIMENTS

From the above-mentioned point of view, extensive studies were carried out to develop a molten metal pouring nozzle for a continuous casting machine having an endless-travelling type mold, in which, when casting molten metal into a cast metal strand by the continuous casting machine having the endless-travelling type mold, a basic end portion of a solidified shell, which causes deterioration of the quality of the cast metal strand and breakage of the pouring nozzle, is never formed on and never adheres to the downstream end face of the molten metal pouring nozzle inserted into the inlet of the mold.

As a result, the following finding was obtained: it is possible to prevent the basic end portion of the solidified shell from being formed on and adhering to the downstream end face of the molten metal pouring nozzle, by directing the flow of molten metal so that molten metal flowing through the bore of the pouring nozzle impinges against the inner surface of the mold, near the downstream end of the pouring nozzle.

The present invention was developed on the basis of the above-mentioned finding.

Now, the molten metal pouring nozzle of the present invention for a continuous casting machine having an endless-travelling type mold is described with reference to the drawings.

Figure 1:
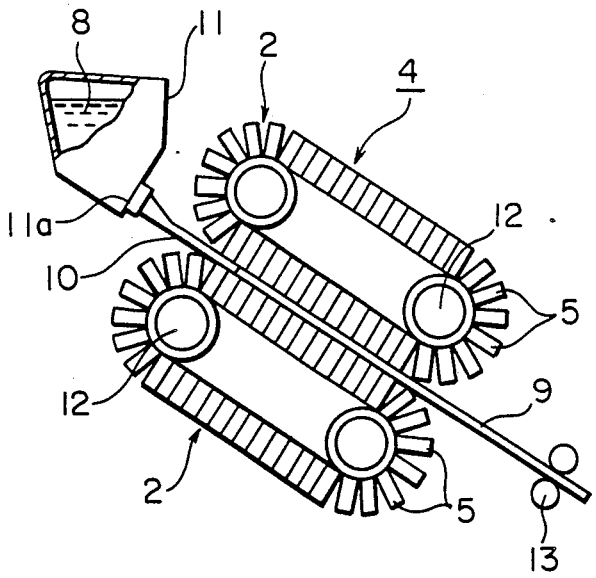
FIG. 1 (PRIOR ART)
FIG. 1 is a schematic side view illustrating a conventional continuous casting machine having an endless-travelling type mold.
Figure 2:
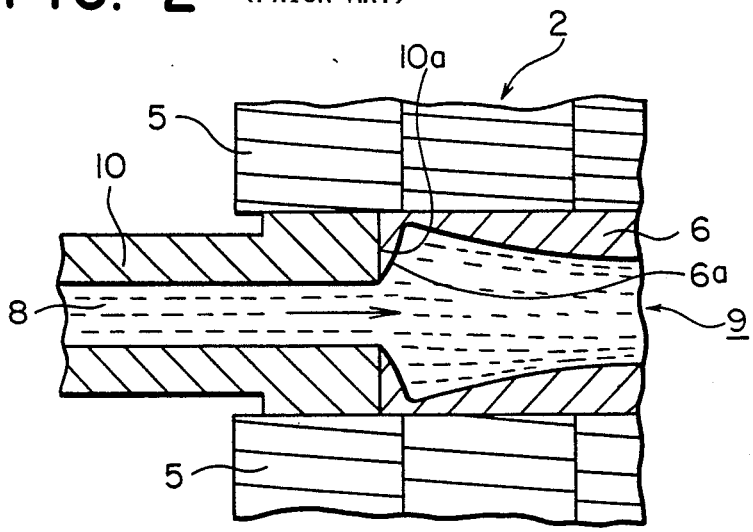
FIG. 2 (PRIOR ART)
FIG. 2 is a partial sectional view illustrating a conventional molten metal pouring nozzle, the downstream end of which is inserted into the inlet of an endless-travelling type mold.
Figure 3:
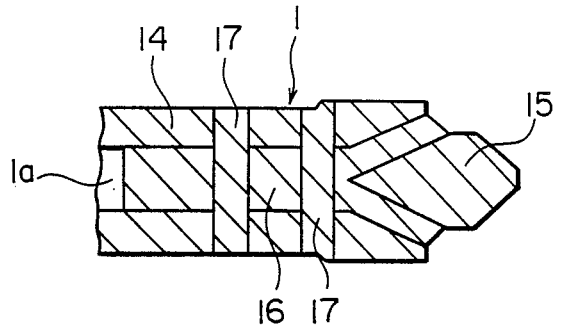
FIG. 3 is a schematic vertical sectional view illustrating a first embodiment of the molten metal pouring nozzle of the present invention.
Figure 4:
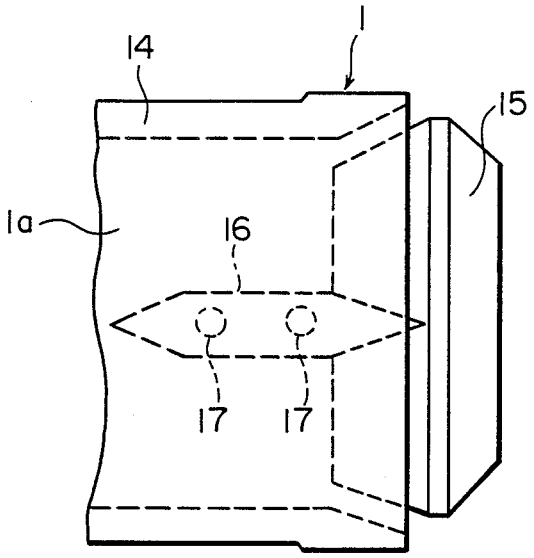
FIG. 4 is a schematic plan view illustrating the molten metal pouring nozzle of the present invention shown in FIG. 3.
Figure 5:
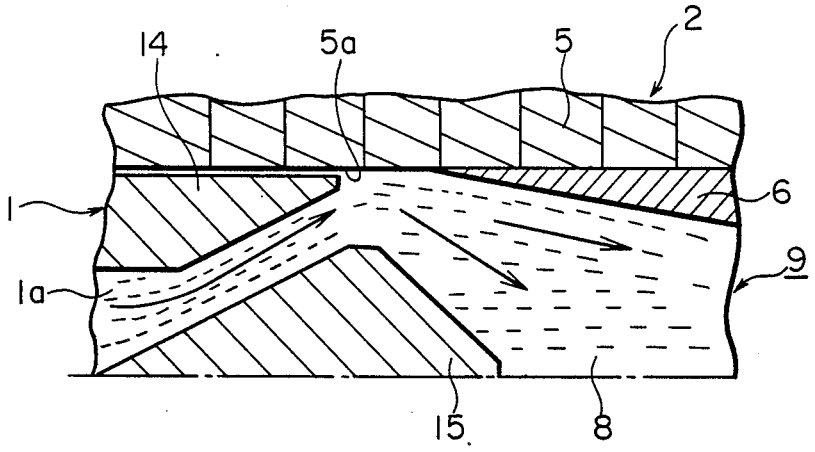
FIG. 5 is a partial sectional view illustrating the molten metal pouring nozzle of the first embodiment of the present invention shown in FIG. 3, the downstream end of which is inserted into the inlet of an endless-travelling type mold.

FIG. 3 is a schematic vertical sectional view illustrating a first embodiment of the molten metal pouring nozzle of the present invention; FIG. 4 is a schematic plan view illustrating the molten metal pouring nozzle of the present invention shown in FIG. 3; and FIG. 5 is a partial sectional view illustrating the molten metal pouring nozzle of the first embodiment of the present invention shown in FIG. 3, the downstream end of which is inserted into the inlet of an endless-travelling type mold. In FIG. 5, the arrow indicates the flow direction of molten metal in the mold. As shown in FIGS. 3 to 5, the molten metal pouring nozzle 1 of the first embodiment of the present invention comprises a nozzle body 14 made of a refractory, and a flow regulator 15 made of the same refractory as that of the nozzle body 14. The nozzle body 14 has a bore 1*a*, through which molten metal 8 flows, along the axial line thereof. The flow regulator 15 is arranged at the center of the downstream end portion of the bore 1*a* of the nozzle body 14.

The flow regulator 15 comprises an upstream portion formed into a wedge shape and a downstream portion formed into a truncated wedge shape. The upstream portion of the flow regulator 15 is positioned at the center of the downstream end portion of the bore 1*a* of the nozzle body 14, and the downstream portion of the flow regulator 15 projects to the outside of the bore 1*a* toward the downstream.

As shown in FIG. 5, the flow regulator 15 forms, in cooperation with the bore 1*a* of the nozzle body 14, a path for molten metal 8, by which molten metal 8 flowing through the bore 1*a* of the nozzle body 14 impinges against the inner surface 5*a* of the mold, i.e., against the surface 5*a* of the wall member 2 of the mold, comprising the plurality of endlessly connected metal blocks 5, near the downstream end of the nozzle body 14. The distance between the inner surface of the bore 1*a* of the nozzle body 14 and the flow regulator 15 is constant throughout the entire length of the above-mentioned path. While the distance between the inner surface of the bore 1*a* of the nozzle body 14 and the flow regulator 15 should preferably be constant throughout the entire length of the path, the pouring nozzle 1 in the first embodiment of the present invention is not necessarily limited to this configuration.

Referring to FIG. 4, the flow regulator 15 is secured in the bore 1*a* of the nozzle body 14 by means of a support 16 made of the same refractory as that of the flow regulator 15, which is arranged longitudinally at the center in the width direction of the downstream end portion of the bore 1*a* of the nozzle body 14. More specifically, the flow regulator 15 and the support 16 are integrally formed with the same refractory so that the downstream end portion of the support 16 is positioned at the center in the width direction of the upstream portion of the flow regulator 15, and the support 16 is fixed to the nozzle body 14 by means of two pins 17 made of the same refractory as that of the support 16, which penetrate vertically the support 16. Whereby, the flow regulator 15 is secured in the bore 1a of the nozzle body 14 as described above. The upstream end portion of the support 16 is formed into a wedge shape so that the flow of molten metal 8 flowing through the bore 1a of the nozzle body 14 may not become turbulent.

As shown in FIG. 5, molten metal 8 flowing through the bore 1a of the nozzle body 14 of the pouring nozzle 1 is poured into the mold through the path formed by the flow regulator 15 and the bore 1a of the nozzle body 14. At this time, the flow direction of molten metal 8 is changed outwardly by the action of the flow regulator 15 as shown by the arrow in FIG. 5, and molten metal 8 impinges against the inner surface 5a of the mold, i.e., against the surface 5a of the wall member 2 of the mold, comprising the plurality of endlessly connected metal blocks 5, near the downstream end of the nozzle body 14. As described above, molten metal 8 always impinges, during the casting, against the surface 5a of the wall member 2 of the mold, near the downstream end of the nozzle body 14. Therefore, although a solidified shell 6 is formed along the surface of the wall member 2, the above-mentioned basic end portion of the solidified shell 6 is never formed on and never adheres to the downstream end face of the nozzle body 14.

The molten metal pouring nozzle 1 of the first embodiment of the present invention may be made with a refractory such as fused silica. In the pouring nozzle 1, the pins 17 are used as described above as means to fix the support 16 to the body nozzle 14, thus making it easy to manufacture the pouring nozzle 1 and giving a high durability. The material of the pin 17 is not limited to the same refractory as that for the support 16.

Figure 6:
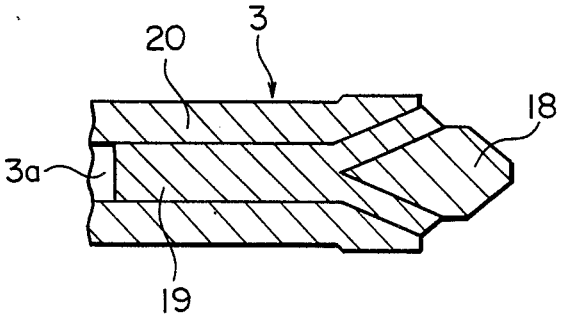
FIG. 6 is a schematic vertical sectional view illustrating a second embodiment of the molten metal pouring nozzle of the present invention.

FIG. 6 is a schematic vertical sectional view illustrating a second embodiment of the molten metal pouring nozzle of the present invention. The pouring nozzle 3 of the second embodiment of the present invention is used also in the above-mentioned continuous casting machine having the endless-travelling type mold. As shown in FIG. 6, the pouring nozzle 3 comprises a nozzle body 20 made of a refractory, and a flow regulator 18 made of the same refractory as that of the nozzle body 20. The nozzle body 20 has a bore 3a, through which molten metal flows, along the axial line thereof. The flow regulator 18 is arranged at the center of the downstream end portion of the bore 3a of the nozzle body 20.

The flow regulator 18 comprises an upstream portion formed into a wedge shape and a downstream portion formed into a truncated wedge shape. The upstream portion of the flow regulator 18 is positioned at the center of the downstream end portion of the bore 3a of the nozzle body 20, and the downstream portion of the flow regulator 18 projects to the outside of the bore 3a toward the downstream.

The flow regulator 18 forms, in cooperation with the bore 3a of the nozzle body 20, a path for molten metal, by which molten metal flowing through the bore 3a of the nozzle body 20 impinges against the surface of the wall member of the mold, near the downstream end of the nozzle body 20.

The flow regulator 18 is secured in the bore 3a of the nozzle body 20 by means of a support 19 made of the same refractory as that of the flow regulator 18, which is arranged longitudinally at the center in the width direction of the downstream end portion of the bore 3a of the nozzle body 20. More specifically, the nozzle body 20, the flow regulator 18 and the support 19 are integrally formed with the same refractory by the conventional rubber-press method for example. Whereby, the flow regulator 18 is secured in the bore 3a of the nozzle body 20 as described above. The upstream end portion of the support 19 is formed into a wedge shape so that the flow of molten metal flowing through the bore 3a of the nozzle body 20 may not become turbulent. The nozzle body 20, flow regulator 18 and the support 19, which are formed integrally, are made from any one of an alumina-graphite refractory and a zirconia-graphite refractory.

The only difference in construction between the molten metal pouring nozzle 1 of the first embodiment and the molten metal pouring nozzle 3 of the second embodiment lies in that: in the pouring nozzle 1 of the first embodiment, the flow regulator 15 and the support 16 are integrally formed, and the support 16 is fixed to the nozzle body 14 by means of the pins 17, whereas, in the pouring nozzle 3 of the second embodiment, all the nozzle body 20, the flow regulator 18 and the support 19 are integrally formed. Therefore, also in the pouring nozzle 3 of the second embodiment, similarly to the pouring nozzle 1 of the first embodiment, molten metal flowing through the bore 3a of the nozzle body 20 always impinges, during the casting, against the surface of the wall member of the mold, near the downstream end of the nozzle body 20. As a result, the above-mentioned basic end portion of the solidified shell is never formed on and never adheres to the downstream end face of the nozzle body 20.

In the molten metal pouring nozzle 3 of the second embodiment, all the nozzle body 20, flow regulator 18 and the support 19 are integrally formed by the rubber-press method as described above, thus making it easy to manufacture the pouring nozzle 3 and giving a high durability.

The molten metal pouring nozzle 1 of the first embodiment and the molten metal pouring nozzle 3 of the second embodiment, as described above, are applicable when continuously casting various molten metal such as molten steel and molten aluminum into a cast metal strand.

The molten metal pouring nozzle of the present invention is not limited to the pouring nozzle 1 of the first embodiment and the pouring nozzle 3 of the second embodiment, but various modification may be made within the scope of the present invention.

Now, the molten metal pouring nozzle of the present invention is described in more detail by means of an Example.

EXAMPLE

The molten metal pouring nozzle 1 of the first embodiment of the present invention made from a refractory comprising fused silica as shown in FIGS. 3 to 5 was prepared. A distance of 8 mm was provided between the inner surface of the bore 1a of the nozzle body 14 of the pouring nozzle 1 and the flow regulator 15, and this distance was kept constant throughout the entire length of the path for molten metal 8 formed by the flow regulator 15 and the bore 1a of the nozzle body 14. Then, the upstream end of the thus prepared pouring nozzle 1 was connected to the tundish, and the downstream end of the pouring nozzle 1 was inserted into the inlet of the endless-travelling type mold of the continuous casting machine. Then, molten aluminum-killed steel 8 was continuously cast at a casting speed of 20 mm/minute for one hour. As a result, molten steel 8 flowing through the bore 1*a* of the nozzle body 14 impinged against the inner surface 5*a* of the mold, i.e., against the surface 5*a* of the wall member 2 of the mold, comprising the plurality of endlessly connected metal blocks 5, near the downstream end of the nozzle body 14. Therefore, the above-mentioned basic end portion of the solidified shell 6 was never formed on and never adhered to the downstream end face of the nozzle body 14, and defects such as cracks and flaws were not observed on the surface of the cast steel strand 9. Furthermore, the downstream end portion of the nozzle body 14 was never broken during the continuous casting. Also during the continous casting, the pouring nozzle 1 was never clogged off.

Even in the case where the continuous casting was carried out with the use of the molten metal pouring nozzle 3 of the second embodiment of the present invention as shown in FIG. 6, the above-mentioned basic end portion of the solidified shell was never formed on and never adhered to the downstream end face of the nozzle body 20 of the pouring nozzle 3, and defects such as cracks and flaws were not observed on the surface of the cast steel strand. Furthermore, the downstream end portion of the nozzle body 20 was never broken during the continuous casting. Also during the continuous casting, the pouring nozzle 3 was never clogged off.

According to the molten metal pouring nozzle of the present invention, as described above in detail, the basic end portion of the solidified shell of the cast metal strand is never formed on and never adheres to the downstream end face of the nozzle body of the pouring nozzle inserted into the inlet of the endless-travelling type mold of the continuous casting machine. Therefore, there are never produced, on the surface of the cast metal strand, defects such as cracks and flaws, which are caused by the basic end portion of the solidified shell, formed on and adhering to the downstream end face of the nozzle body of the pouring nozzle. According to the molten metal pouring nozzle of the present invention, furthermore, the downstream end portion of the nozzle body of the pouring nozzle is hardly broken during the casting operation, thus permitting the continuous casting for a long period of time and leading to improvement of operating efficiency. Thus, according to the molten metal pouring nozzle of the present invention, many industrially useful effects are provided.

What is claimed is:

1. A continuous casting machine comprising:

an endless-travelling type mold including two pairs of opposing wall members endlessly travelling in the same direction and at the same speed;

a pouring nozzle having one end which is connected to a tundish for receiving molten metal, and another end which is inserted into said mold;

said pouring nozzle being made of a refractory material and comprising a nozzle body and a flow regulator;

said nozzle body having a bore, through which molten metal flows, along an axial line thereof, in a downstream direction a sectional area of a downstream end portion of said bore of said nozzle body becoming gradually larger toward a downstream end thereof;

said flow regulator being arranged at the center of the downstream end portion of said bore of said nozzle body, and said flow regulator forming, in cooperation with said bore, a path for molten metal, by which molten metal flowing through said bore impinges against an inner surface of said mold, near the downstream end of said nozzle body;

the improvement wherein:

said flow regulator (15, 18) has an upstream portion formed into a wedge shape, and at least part of said upstream portion of said flow regulator (15,18) is arranged in said bore (1*a*,3*a*) of said nozzle body (14,20);

the distance between the inner surface of said bore (1*a*,3*a*) of said nozzle body (14,20) and said upstream portion of said flow regulator (15,18) is constant throughout the entire length of said path; and said flow regulator (15,18) is secured in said bore (1*a*,3*a*) of said nozzle body (14,20) by means of a support (16,19) made of a refractory material, said support being arranged in said bore (1*a*,3*a*) of said nozzle body (14,20).

2. A continuous casting machine as claimed in claim 1, wherein:

said flow regulator (15) and said support (16) are integrally formed of the same refractory; and said support (16) is fixed to said nozzle body (14) by means of at least one pin (17), whereby said flow regulator (15) is secured in said bore (1*a*) of said nozzle body (14).

3. A continuous casting machine as claimed in claim 1, wherein:

said nozzle body (20), said flow regulator (18) and said support (19) are integrally formed of the same refractory, whereby said flow regulator (18) is secured in said bore (3*a*) of said nozzle body (20).

4. A continuous casting machine as claimed in claim 3, wherein:

said refractory is an alumina-graphite refractory.

5. A continuous casting machine as claimed in claim 3, wherein:

said refractory is a zirconia-graphite refractory.

* * * * *